US009394721B2

(12) United States Patent
Hotes et al.

(10) Patent No.: US 9,394,721 B2
(45) Date of Patent: Jul. 19, 2016

(54) PORTABLE SHELTER AND FRAME

(71) Applicant: Alaska Structures, Inc., Kirkland, WA (US)

(72) Inventors: Richard W. Hotes, Anchorage, AK (US); Michael Vesper, Adamstown, MD (US)

(73) Assignee: Alaska Structures, Inc., Kirkland, WA (US)

( * ) Notice: Subject to any disclaimer, the term of this patent is extended or adjusted under 35 U.S.C. 154(b) by 0 days.

(21) Appl. No.: 13/754,046

(22) Filed: Jan. 30, 2013

(65) Prior Publication Data

US 2013/0206197 A1 Aug. 15, 2013

Related U.S. Application Data

(60) Provisional application No. 61/598,194, filed on Feb. 13, 2012.

(51) Int. Cl.

| | |
|---|---|
| ***E04H 15/36*** | (2006.01) |
| ***E04H 15/48*** | (2006.01) |
| ***E04H 15/02*** | (2006.01) |
| ***E04H 15/18*** | (2006.01) |

(52) U.S. Cl.

CPC ..... *E04H 15/36* (2013.01); *E04H 15/02* (2013.01); *E04H 15/18* (2013.01); *E04H 15/48* (2013.01)

(58) Field of Classification Search

USPC ..... 135/96, 124, 128, 130, 138, 143, 144, 135/153, 906, 905

See application file for complete search history.

(56) References Cited

U.S. PATENT DOCUMENTS

| | | | | | |
|---|---|---|---|---|---|
| 1,504,889 | A | * | 8/1924 | Hansen | 135/153 |
| 2,055,044 | A | * | 9/1936 | Nelson | 135/125 |
| 2,225,972 | A | * | 12/1940 | Brogren | 135/138 |
| 2,516,869 | A | * | 8/1950 | Harris | 135/126 |
| 2,797,696 | A | | 7/1957 | Fritsche | |
| 3,028,872 | A | * | 4/1962 | Cresswell | 135/94 |
| 4,074,682 | A | | 2/1978 | Yoon | |
| 4,077,417 | A | * | 3/1978 | Beavers | 135/121 |
| 4,649,947 | A | * | 3/1987 | Tury et al. | 135/97 |
| 4,667,692 | A | * | 5/1987 | Tury et al. | 135/156 |
| 4,887,397 | A | * | 12/1989 | Peterson | 52/86 |
| 5,381,634 | A | * | 1/1995 | Pietrogrande et al. | 52/86 |
| 5,842,495 | A | * | 12/1998 | Egnew et al. | 135/133 |
| 6,679,009 | B2 | * | 1/2004 | Hotes | 52/86 |

(Continued)

FOREIGN PATENT DOCUMENTS

| | | | |
|---|---|---|---|
| CN | 2523868 | Y | 12/2002 |
| DE | 3718052 | A1 | 12/1988 |

(Continued)

*Primary Examiner* — Noah Chandler Hawk
(74) *Attorney, Agent, or Firm* — Blank Rome LLP

(57) ABSTRACT

A portable shelter is provided for sheltering materials or human occupants at a remote location. The shelter includes, among other things, a flexible cover and a supporting frame. In operation, hinged members that are part of the frame are used to support a first portion and then a second portion of the shelter. Before the frame is raised up, the people who are constructing it can easily reach the top parts of the shelter without a stepladder or the like. By avoiding the need for a stepladder, the overall size and weight of the assembled components that have to be transported to the remote location can be reduced, and the shelter can be constructed more quickly and easily. Hinges, purlin connections, and corner closure systems for the shelter are also disclosed.

8 Claims, 13 Drawing Sheets

(56) References Cited

U.S. PATENT DOCUMENTS

| | | | | |
|---|---|---|---|---|
| 7,178,538 | B2 * | 2/2007 | Ransom | 135/125 |
| 2008/0029143 | A1 * | 2/2008 | Yoon | 135/128 |
| 2010/0126545 | A1 | 5/2010 | Bullivant et al. | |
| 2011/0284044 | A1 * | 11/2011 | Baldussi | 135/124 |
| 2012/0216845 | A1 * | 8/2012 | Noll | 135/124 |

FOREIGN PATENT DOCUMENTS

| | | | |
|---|---|---|---|
| GB | 2 094 367 | A | 9/1982 |
| WO | WO 91/19872 | A1 | 12/1991 |

* cited by examiner

PORTABLE SHELTER AND FRAME

This application claims the benefit of U.S. Provisional Application No. 61/598,194, filed Feb. 13, 2012. The entire disclosure of the provisional application is incorporated into this application by reference.

BACKGROUND

Although a number of portable shelters, tents and housing units have been suggested in the art, they all have or would have disadvantages. U.S. Pat. No. 4,945,936 (Surrendi) shows a shelter that has hinged legs 2 which pivot radially outward and downward as the top is raised like an umbrella. The legs 2 are shown in their folded position in FIG. 2, and in their straightened position in FIG. 1. In contrast to the preferred embodiment described below. Surrendi does not suggest building the top portion of a large shelter, then lifting a first side of the shelter, unhinging or unfolding legs at the first portion from under the shelter, and then lifting the other side of the shelter, and then unhinging legs at the other end from under the shelter.

U.S. Pat. No. 5,813,425 (Carter) shows a collapsible shelter that has an elevated canopy, where a top section is pushed up as the legs 24, 26 are telescopically extended. The Carter shelter is said to be useful at emergency sites, for temporary care and housing (column 1, lines 17-21), and is said to provide more headroom than other such shelters (column 1, lines 38-42). Carter does not, however, suggest that the top section is built first; and the legs 24, 26 of the Carter shelter may be telescoped upwardly all at the same time. There is nothing in Carter about lifting one side or portion of a partially-constructed shelter, and then lifting the other portion. Like Surrendi, and in contrast to the preferred embodiment described below, Carter does not suggest building the top portion of a shelter, then lifting a first portion of the shelter, unhinging or unfolding legs at the first portion, and then lifting another portion of the shelter, and then straightening out legs at the other end.

U.S. Pat. No. 6,199,572 (Rousselle) refers to military and disaster-relief situations where substantial shelters/tents need to be constructed quickly (column 8, lines 50-60), and Rousselle says that its tent can be constructed without a ladder (column 13, lines 54-57). Rousselle shows, in FIG. 1D, an umbrella-style tent frame, where hinged (312) leg tubes 310 are folded radially outward and downward (1) to raise the shelter/tent.

SUMMARY

The disadvantages of the prior art can be overcome to a great extent by a portable shelter (e.g., an emergency medical tent that is on the order of thirty-two feet long), that can be assembled rapidly by hand with just a few people. Importantly, even though the shelter may have more than eight feet (preferably at least seven feet) of headroom inside (higher than those who are setting up the shelter can reach conveniently), the shelter can be assembled without a stepladder. The shelter has improved portability (it is easy to transport and quick to set up), and the shelter may be less expensive to produce and deploy than known shelters.

In operation, the top portion of the shelter (e.g., the top five feet) is assembled first. At this stage, nothing is too high to be reached by the people who are doing the set-up. The supporting legs, which may be made of aluminum, are hinged together, and are folded under the top portion of the shelter. So, after the top part is assembled, one side of the shelter is lifted up the remaining three feet or so (conveniently to about waist-height of the person doing the lifting), and then the hinges in the legs at that end are straightened out, and then the other end of the shelter is lifted up, and then the hinges on the legs at the second end are straightened out, and the bottom portion (the bottom three feet or so) of the shelter is then assembled/covered.

According to a preferred embodiment, a portable shelter may be provided for sheltering materials or human occupants at a remote location. The shelter may have, among other things, a flexible cover and a rigid, supportive frame. The cover may be formed of canvas or the like, and a flexible liner may be provided, if desired. The frame may be made of lightweight tubes or poles, with various hinges and connections. In operation, hinged members (legs) on a first side of the shelter may be unfolded to raise the first side of the shelter, and like hinged members on the opposite side of the shelter may be unfolded to raise the opposite side of the shelter, after the cover is provided on the frame, such that the shelter can be built to an intermediate height, and then raised up to a final height. The intermediate height may be low enough for the people who assemble the shelter to easily reach all parts of the top half of the shelter, yet high enough for those people to walk through the partially constructed shelter. When the shelter is raised to its final height, the top of the shelter may be high enough to provide comfortable headroom within the shelter, and clearance space for a ventilation plenum, lighting and the like, and therefore out of reach of the people doing the construction.

A preferred method of constructing a shelter, which may be a tent, a home, a medical facility, etc., includes the steps of unfolding plural multi-piece frame assemblies to partially-extended configurations, then bracing the frame assemblies together, then locating a weather-proof flexible cover over the frame assemblies, then unfolding first portions of the frame assemblies to support a corresponding first portion of the cover, and then unfolding second portions of the frame assemblies to support a corresponding second portion of the cover. If desired, the step of unfolding the assemblies may include the step of extending at least four arch assemblies to partially-extended configurations. If desired, a flexible floor may be installed underneath the frame assemblies, and the floor may be connected to end portions of the frame assemblies and/or the cover, to provide desired tension within the floor, such that the floor is maintained in a stable, flat condition during use of the shelter.

All of the components of the shelter should be sufficiently lightweight to be easily stored and/or transported to a remote location, including by way of helicopter or air transport. The components of the structure, which may be assembled/packaged in a single crate or other container, include arch assemblies that are each made up of arch members hinged and folded together so that, when folded, the arch assemblies are not substantially longer than any one of the arch members; and braces for connecting the arch assemblies together in an essentially parallel arrangement, none of the braces being substantially longer than any of the arch members. During construction of the portable structure, the arch members are configured to be unfolded from the respective arch assemblies while raising a first portion and then a second portion of the structure.

According to another embodiment, two or more structures may be aligned end-to-end, and the devices (zippers, hook and loop fasteners, and the like) that are used to connect the end panels to the individual structures may be used to secure open ends of the structures together.

DETAILED DESCRIPTION

Figure 1:
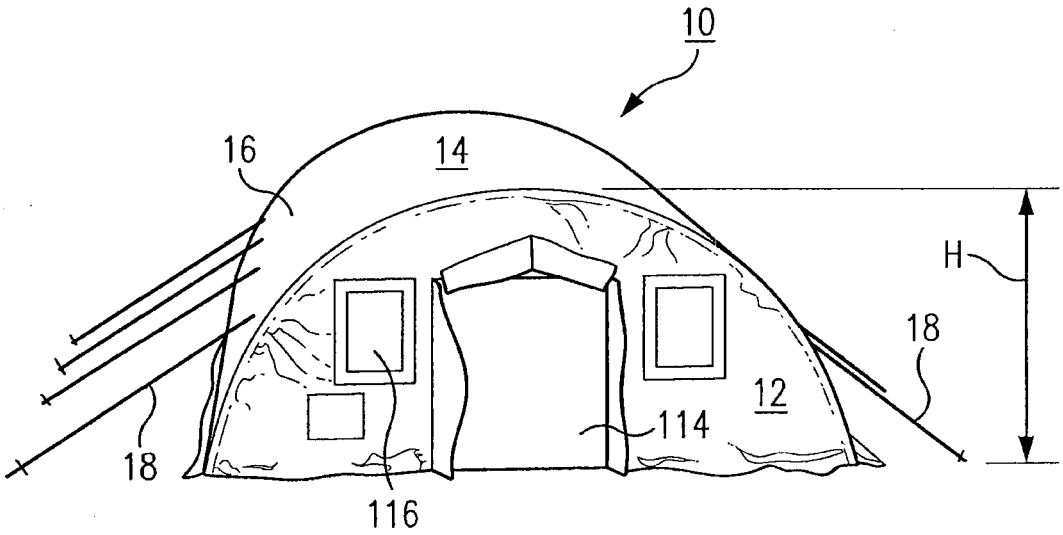
FIG. 1 is a perspective view of a shelter constructed in accordance with a preferred embodiment.

Turning now to the drawings, where like reference numerals designate like elements, there is shown in FIG. 1 a shelter 10 that is constructed in accordance with a preferred embodiment of the present invention. The shelter 10 has a front wall 12, a back wall (not shown), a roof 14, and side walls 16. The left side wall (not shown) is the mirror image of the right side wall 16. The front and back walls 12, the roof 14, and the side walls 16 are supported by a suitable frame (not shown in FIG. 1) made of lightweight aluminum (or steel) tubes, wooden poles, or the like. Depending on expected wind and other conditions, the shelter 10 may be tied to the ground by wires or ropes 18, stakes, or the like.

The shelter 10 is made from components that can be assembled or packaged into a compact shipping container, and transported as such to a remote location. If desired, the shelter can be constructed at the remote location in a short period of time by people working without power tools, and without a stepladder. In the illustrated embodiment, the components may be pre-grouped into separate bags or other containers each of which can be lifted, carried and handled by a single person, for rapid positioning of the components to the approximate respective locations where they are installed into the shelter, as described below in more detail.

Figure 2:
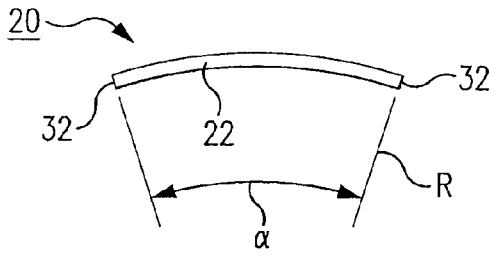
FIG. 2 is a front view of an arch assembly for the shelter of FIG. 1, in a folded configuration.
Figure 3:
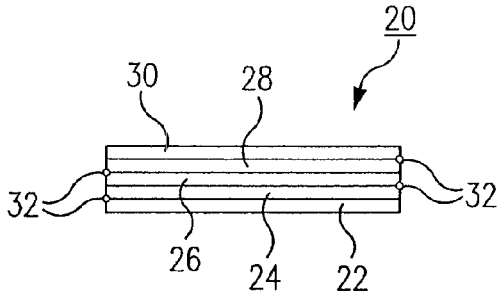
FIG. 3 is a top view of the arch assembly of FIG. 2, in the folded configuration.

FIGS. 2 and 3 are front and top views, respectively, of an arch assembly 20, in a folded (collapsed) configuration, that forms part of the frame for the shelter 10. The arch assembly 20 is made up of five arch members 22, 24, 26, 28, 30 joined to each other by suitable hinges 32. There are four such hinges 32 for each arch assembly 20, as shown in FIG. 3. Each arch member 22, 24, 26, 28, 30 is curved and has essentially the same elongated, arcuate shape, so that the arch members 22, 24, 26, 28, 30 line up behind each other in the folded configuration, as shown in FIG. 2. Each arch member 22, 24, 26, 28, 30 extends through an arc a that is within the range of from about thirty degrees to about forty degrees, and is preferably about thirty-six degrees. The radius R of the arc $\alpha$ is about equal to the height (head room) H (FIG. 1) of the shelter 10 along its longitudinal centerline. The height H may be at least seven feet, preferably in the range of from about eight feet to about fourteen feet, and preferably about twelve feet.

Figure 4:
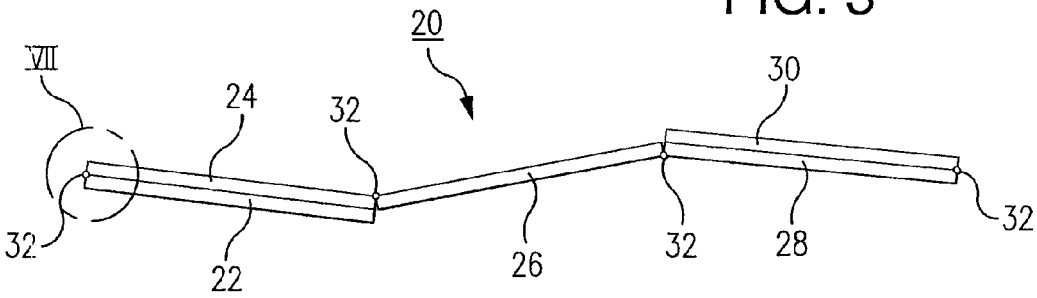
FIG. 4 is a top view of the arch assembly of FIG. 2, in a partially-extended, semi-arch configuration.
Figure 5:
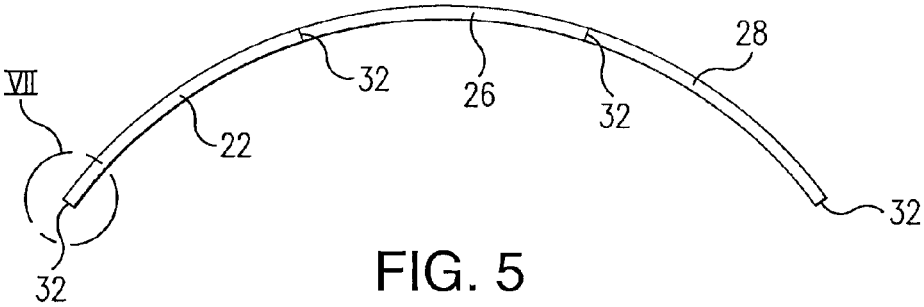
FIG. 5 is a front view of the arch assembly of FIG. 2, in a fully-extended, semi-arch configuration.
Figure 6:
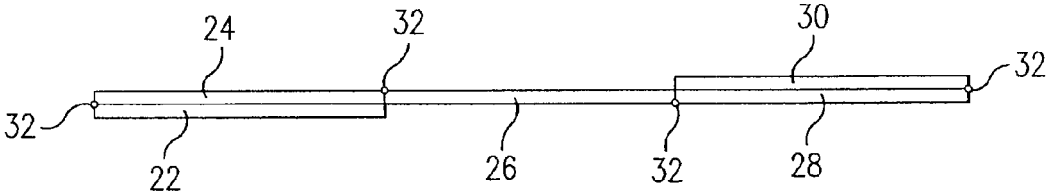
FIG. 6 is a top view of the arch assembly of FIG. 2, in the fully-extended, semi-arch configuration.
Figure 7:
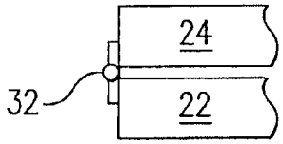
FIG. 7 is an enlarged top view of the hinged portion identified in FIGS. 4 and 5 by circle VII.

In operation, the arch assembly 20 can be unfolded to the partially-extended semi-arch configuration shown in FIG. 4 (a top view of the arch assembly 20), and, from there, the assembly 20 can be further unfolded to the fully-extended, semi-arch configuration shown in FIGS. 5 and 6 (front and top views, respectively). The hinge 32 between the second and third arch members 24, 26, and the hinge 32 between the third and fourth arch members 26, 28 may then be snapped or locked in place so that the three middle arch members 24, 26, 28 remain arcuately aligned and do not easily return to the partially-extended configuration shown in FIG. 4.

Figure 8:
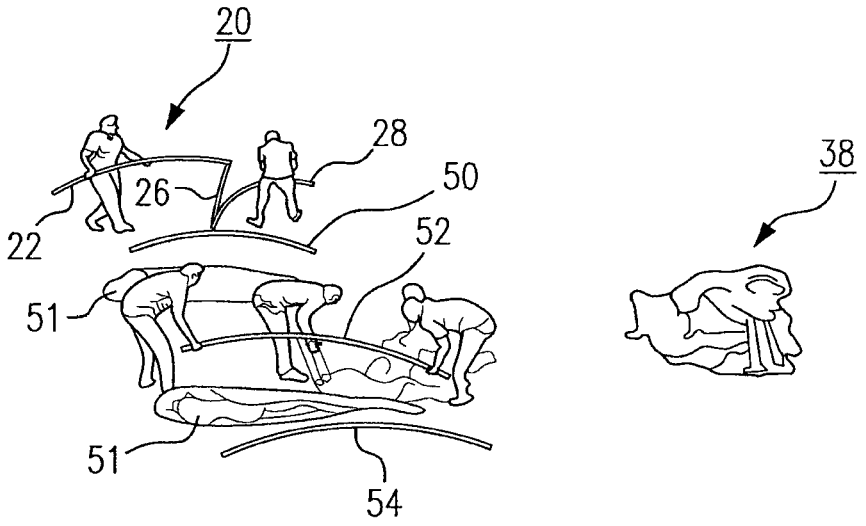
FIG. 8 is a perspective view of the shelter of FIG. 1, in a preliminary stage of construction.

In the illustrated embodiment, there are six arch assemblies 20, 50, 52, 54, 56, 58 that are essentially identical to each other. The first four arch assemblies 20, 50, 52, 54 are shown in FIG. 8, where the first arch assembly 20 is shown in its partially-extended semi-arch configuration, and the second through fourth arch assemblies 50, 52, 54 are in their collapsed (folded) configurations. In the preliminary stage of construction shown in FIG. 8, the fifth and sixth arch assemblies are located within bags 51 or other packages suitable for carrying components of the frame from a main transport container 38 to the approximate locations where the arch assemblies are assembled into the frame.

Figure 9:
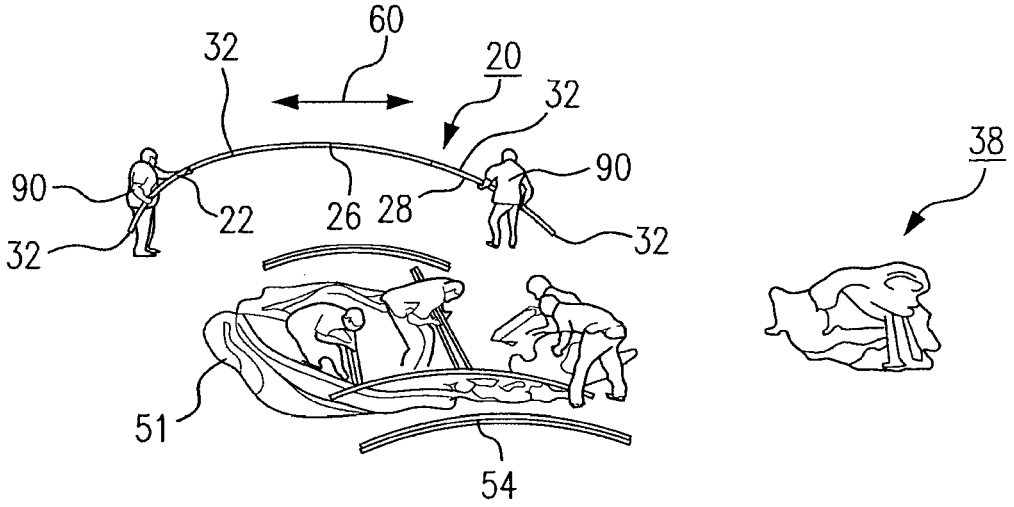
FIG. 9 is a perspective view of the shelter of FIG. 1, in an intermediate stage of construction, subsequent to the preliminary stage of construction shown in FIG. 8.

In a subsequent stage of construction, shown in FIG. 9, the first arch assembly 20 is unfolded and locked into its fully-extended, semi-arch configuration. The unfolding operation may be performed by two people 90 who pull the second and fourth members 24, 28 of the assembly 20 away from each other, in the direction indicated by double arrows 60, until the three middle members 24, 26, 28 all lie in the same plane, with the hinges 32 between the middle members 24, 26, 28 snapped or locked in place, as shown in FIGS. 5 and 6.

Figure 10:
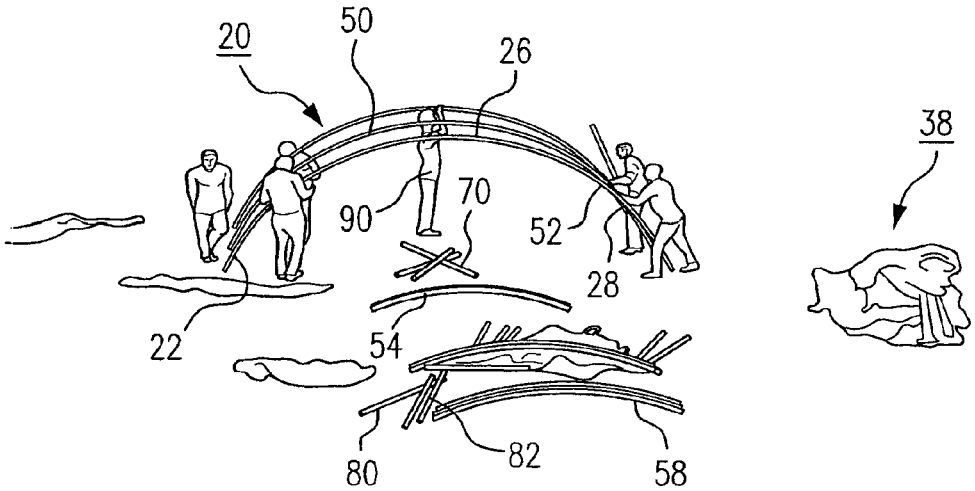
FIG. 10 is a perspective view of the shelter of FIG. 1, in another intermediate stage of construction, subsequent to the stage of construction shown in FIG. 9.
Figure 11:
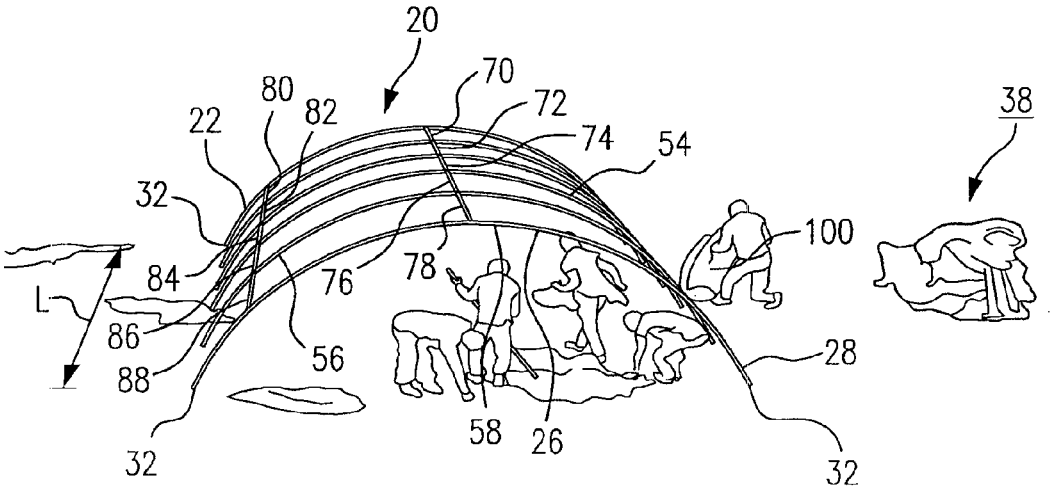
FIG. 11 is a perspective view of the shelter of FIG. 1, in another intermediate stage of construction, subsequent to the stage of construction shown in FIG. 10.

Then, as shown in FIGS. 10 and 11, the second through sixth arch assemblies 50, 52, 54, 56, 58 may be successively unfolded, extended, and locked into their fully-extended, semi-arch configurations, so that they are each configured essentially identical to the first arch assembly 20 (as shown in FIGS. 5 and 6). The six arch assemblies 20, 50, 52, 54, 56, 58 may be successively positioned upright as shown in FIGS. 10 and 11 and braced into parallel alignment by fifteen straight brace arms, all of which may be essentially identical to each other. Five of the brace arms 70, 72, 74, 76, 78 are longitudinally aligned along a top ridge of the frame, and are connected to the six arch assemblies 20, 50, 52, 54, 56, 58, respectively.

The top brace arms 70, 72, 74, 76, 78 may be connected to suitable connectors located at the midpoints of the six middle arch members 26. Exemplary connections 180, 182 (FIGS. 20-24) are described in more detail below. Five other brace arms 80, 82, 84, 86, 88 are aligned along the right side of the frame, and are also connected to the six arch assemblies 20, 50, 52, 54, 56, 58. The right-side brace arms 80, 82, 84, 86, 88 may be connected to the respective second arch members 24. The remaining five brace arms (visible in FIG. 18) are aligned along the left side of the frame, where they are each connected to two of the respective fourth arch members 28.

At this intermediate stage of the construction, as shown in FIG. 11, the first and fifth arch members 22, 30 of each arch assembly 20, 50, 52, 54, 56 remain folded into the configuration shown in FIGS. 5 and 6. That is, the first and fifth arch members 22, 30 remain next to the respective second and fourth arch members 24, 28. As a result, the frame rests on the six hinges 32 that are located between the first and second arch members 22, 24, and the six hinges 32 that are located between the fourth and fifth arch members 28, 30. Those twelve hinges 32 are in contact with the ground. As a result, the top of the frame (where the top brace arms 70, 72, 74, 76, 78 are located) may be no more than about eight feet above the ground. This way, it is easy for the people who are constructing the frame to reach the highest points within the shelter 10 without using a stepladder or other means for increasing the height of their reach.

As shown in FIG. 10, for example, it is easy for a person 90 to reach the top of the frame to connect the ends of the first brace arm 70 to the center arch members 26 of the first and second arch assemblies 20, 50. When the frame is in the configuration shown in FIG. 11, it is easy for people to walk under the frame, yet no assistance, such as a stepladder, is needed for the same people to reach the top (or any other part) of the frame. When the frame is in the configuration shown in FIG. 11, a ventilation plenum (not shown) may be attached to the uppermost parts of the frame. The plenum may be a flexible tube with selectively openable openings along its length. The plenum may extend from one end of the frame to the other. One end of the plenum may be connected to a source of HVAC ventilation, to distribute heated or cooled air throughout the interior of the shelter. In addition to, or instead of, installing the plenum, electrical lighting and/or electrical wiring may be connected to upper portions of the frame, if desired, while the frame is in the FIG. 11 configuration, and before the shelter is raised up to its finished height.

Figure 12:
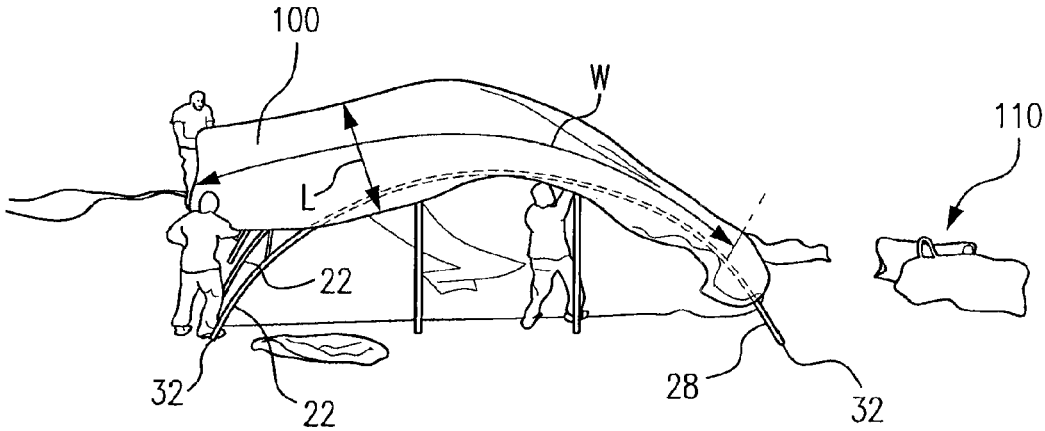
FIG. 12 is a perspective view of the shelter of FIG. 1, in another intermediate stage of construction, subsequent to the stage of construction shown in FIG. 11.
Figure 14:
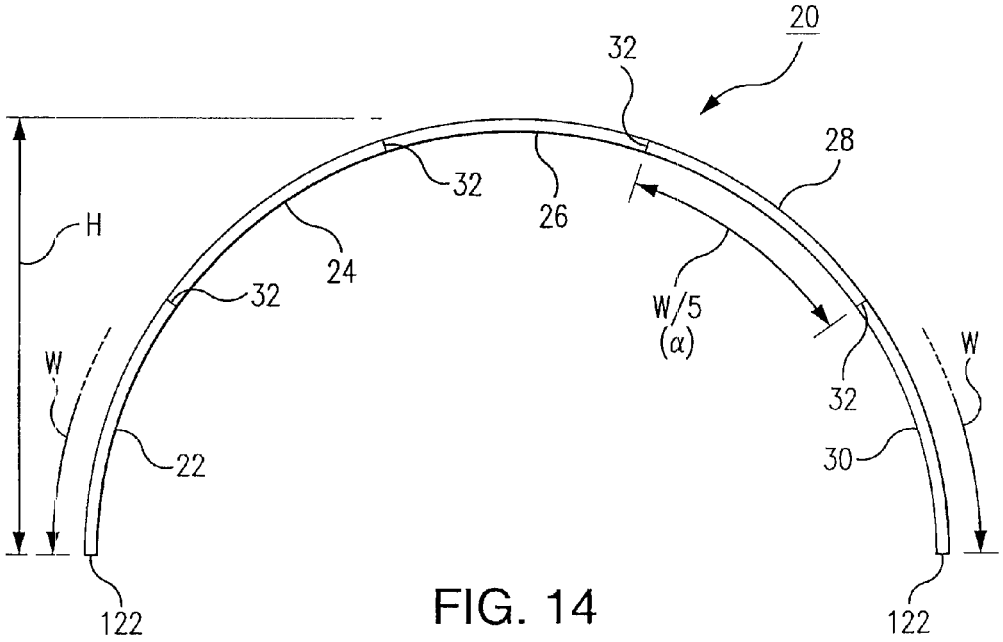
FIG. 14 is a front view of the arch assembly of FIG. 2, in a fully-extended, full-arch configuration.

As shown in FIG. 12, a liner layer 100 may be pulled over the frame. The liner layer 100 may be formed of a flexible material with a rectangular shape. The length L of the liner layer 100 may be the same as, or slightly greater than, the total length L of the frame (FIG. 11), for example, within the range of from about twenty feet to about fifty feet. The length of each of the brace members 70, 72, 74, 76, 78, 80, 82, 84, 86, 88 may be about L/5. The circumferential width W of the liner may be about the same as, or slightly wider than the arcuate length W of each arch assembly 20, 50, 52, 54, 56, 58 measured along its arc, as shown in FIG. 14. The length of each arch member 22, 24, 26, 28, 30 may be about W/5. The width W may be related to the frame height H as follows: $W \approx \pi H$, where $\alpha \approx 180°/5$.

After the liner layer 100 is installed over the frame, and the inner surface of the liner layer 100 is secured to the top of the frame, a cover 110 (FIG. 13) may be pulled over the liner layer 100 using suitable ropes (not shown). The length L of the cover 100 may about the same as, or slightly greater than, that of the frame, and the cover 110 may have flexible semi-circular portions 112 that form the front and back walls 12 of the shelter 10. The front portion 112 of the cover 110 may have, for example, a door 114 and two windows 116. If desired, the ventilation plenum discussed above, or another arrangement for supplying forced air into the shelter 10 from a suitable HVAC unit (not shown), may be installed while the shelter 10 is in the FIG. 13 configuration.

Figure 13:
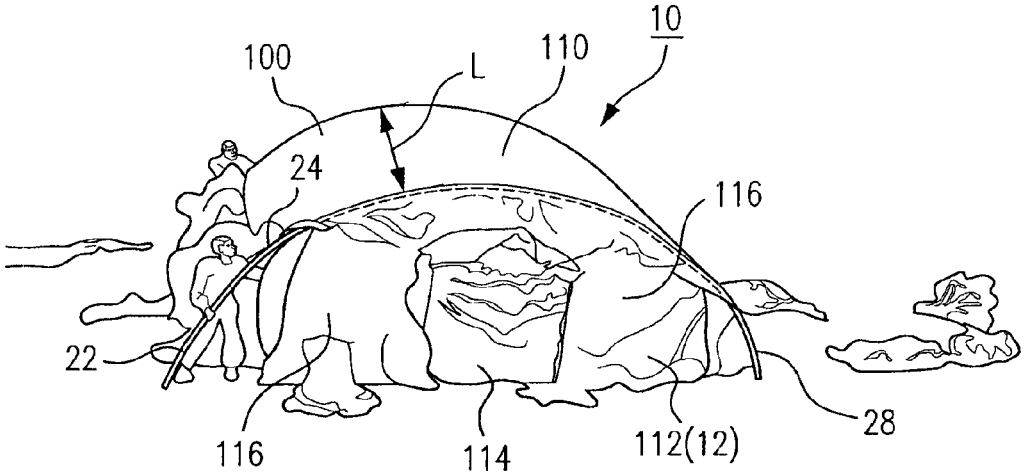
FIG. 13 is a perspective view of the shelter of FIG. 1, in another intermediate stage of construction, subsequent to the stage of construction shown in FIG. 12.
Figure 15:
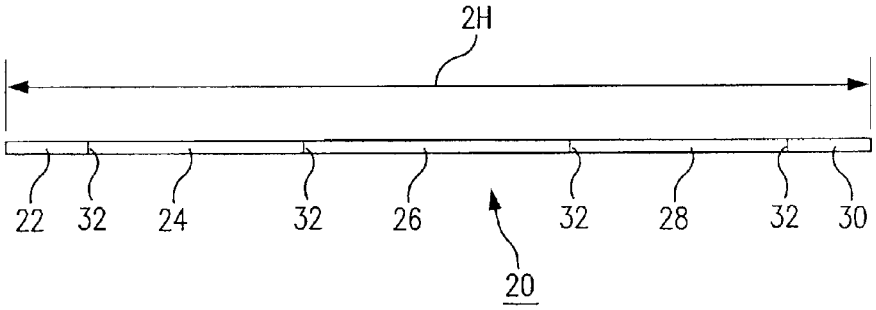
FIG. 15 is a top view of the arch assembly of FIG. 2, in the fully-extended, full-arch configuration.
Figure 16:
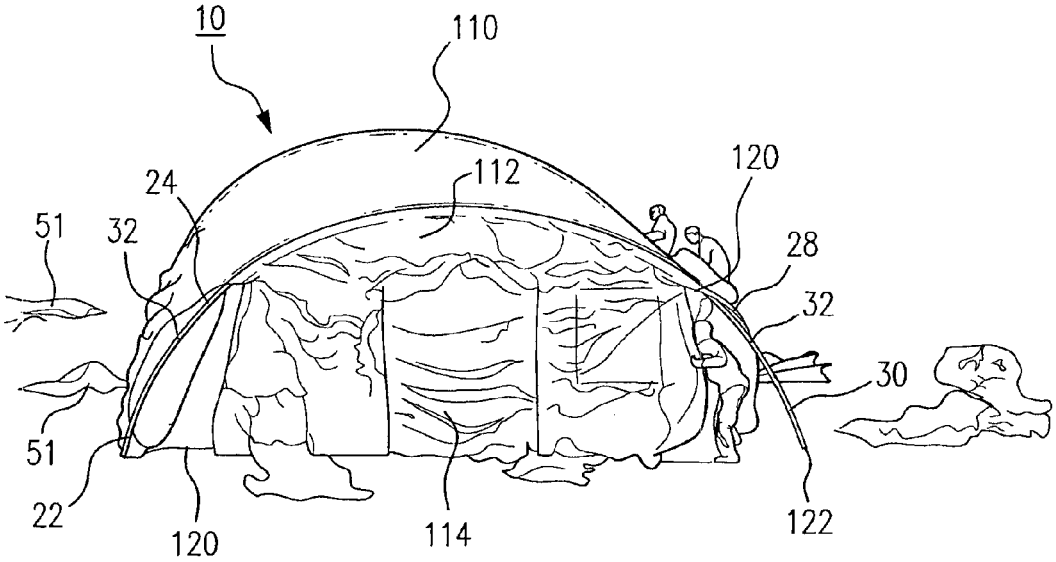
FIG. 16 is a perspective view of the shelter of FIG. 1, in a near-finished stage of construction, subsequent to the stage of construction shown in FIG. 13.

Then, after the cover 110 is placed over the liner 100, the first arch members 22 are folded out (away from the respective second arch members 24), and snapped or locked into place, so that the first arch members 22 are arcuately aligned with the respective middle arch members 24, 26, 28. This causes the right side of the shelter 10 to be higher than the left side of the shelter 10, as shown in FIG. 13. Subsequently, the fifth arch members 30 (FIG. 16) are folded out (away from the respective fourth arch members 28), and the respective hinges 32 are snapped or locked into place, so that the six arch assemblies 20, 50, 52, 54, 56, 58 each assume the fully-extended, fully-assembled configuration shown in FIGS. 14 and 15. Unfolding the fifth arch members 30 causes the left side of the shelter 10 to reach the same height as the right side of the shelter 10. In the FIG. 16 configuration, the top of the shelter 10 is too high for an average person to reach points at the top of the shelter 10 without a stepladder or other means of increasing the height of his or her reach. The inside height (headroom) H of the shelter 10 (FIGS. 1 and 16) may be, for example, about twelve feet.

The axes of rotation of the hinges 32 are perpendicular to the longitudinal extent (extending in the direction of length L) of the shelter 10. Consequently, as first arch members 22 are rotated away from the second arch members 24, the movement of each first arch member 22 relative to the respective second arch member 24 is through a plane that is essentially perpendicular to a line that extends from the respective hinge 32 toward the longitudinal center line of the floor of the shelter 10.

There are seams 120 between the front and back portions 112 of the cover 110 and the main rectangular portion of the cover 110. The seams 120 may be used to permit entry into the shelter 10 during assembly/construction, while the door 114 is closed. The seams 120 also make it easier for people to reach the first and fifth arch members 22, 30, to lift and lock the right side, and then the left side, of the shelter 10 into the position shown in FIG. 16. In the FIG. 16 configuration, the seams 120 are formed by partially unzipped zippers, as discussed in more detail in connection with FIG. 25. The seams 120 are shown in more detail in FIG. 25.

Figure 25:
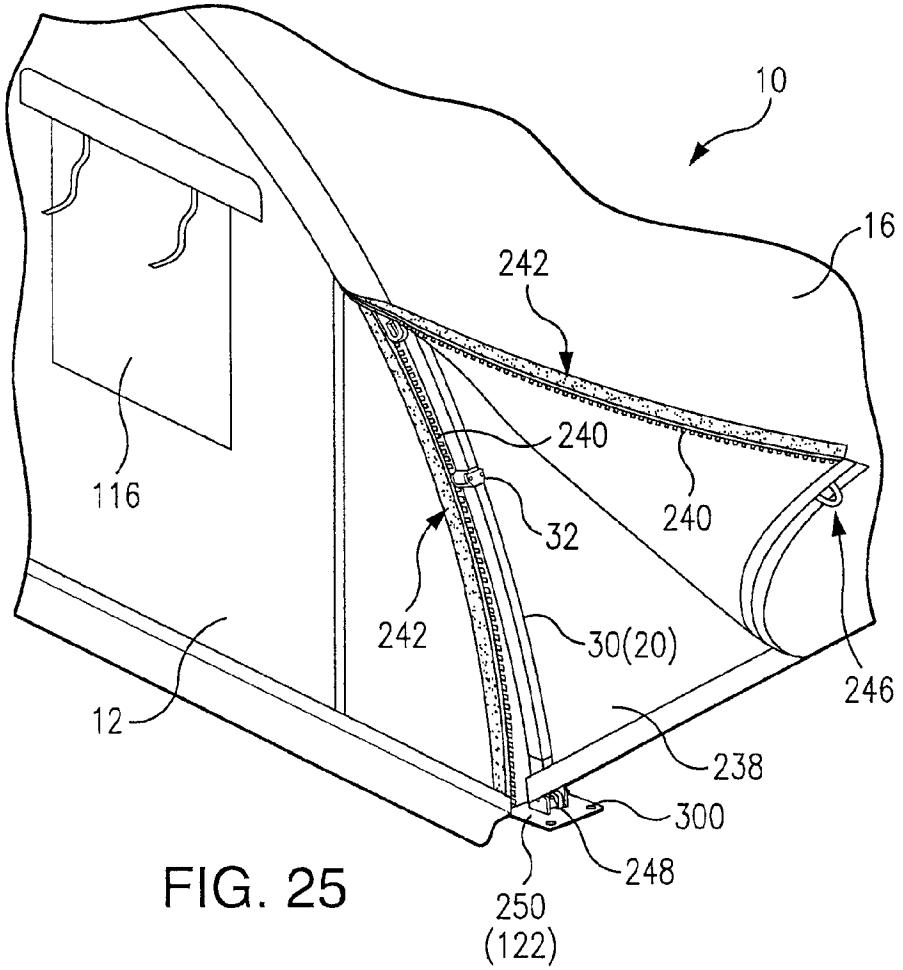
FIG. 25 is a partial perspective view of the shelter of FIG. 1, showing exemplary details of a corner thereof.

Before the construction of the shelter 10 is finally completed, the seams 120 may be closed by suitable hook and loop fasteners 242 (FIG. 25). The bottom edges of the cover 110 all around the shelter 10, where the cover 110 meets the ground, may be sealed to a flexible floor that is located underneath the frame. If desired, the bottom ends 122 of the first and fifth arch members 22, 30 may be attached to the floor (not illustrated, discussed below); and the ropes 18 shown in FIG. 1 may then be secured to stakes located in the ground, to provide a stable, secure finished structure.

A flexible floor (not illustrated) may be installed within the shelter 10. The floor may be connected to the edges of the shelter and thereby stretched tight. The floor may have a length and width respectively slightly greater than L and 2H (that is, slightly greater than the length and width L, 2H of the shelter 10). The extra material at the edges of the floor may be folded upwardly and then sealed (for example, by hook and loop fasteners) to inner surfaces of the cover 110. This way, the floor has a "bath tub" configuration to help ensure that dust, insects and the like do not get into the shelter above the edges of the floor.

In a preferred embodiment, holes 300 in base pads 250 (discussed below in connection with FIG. 25) may receive stakes to help secure the shelter to the ground.

Figure 17:
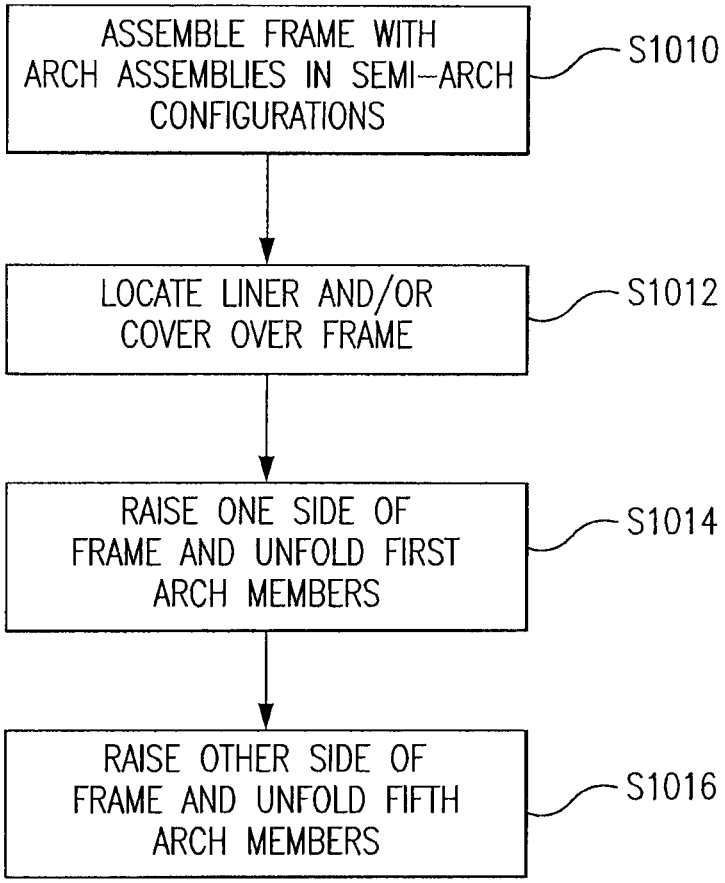
FIG. 17 is a flowchart that illustrates a Method of making the shelter of FIG. 1.

In summary, the shelter 10 may be constructed in two stages. First, the arch assemblies 20, 50, 52, 54, 56 are extended to their semi-arch configurations (S1010, FIG. 17), and aligned and braced into the stable arrangement shown in FIG. 11. Then, a liner 100 and/or a cover 110 are pulled over the frame (FIGS. 12 and 13; S1012, FIG. 17). Then, the people who are constructing the shelter 10 lift, by hand, the right side of the frame, and cause the ends 122 of all of the first arch members 22 to come into contact with the ground (S1014). Then, the same people lift, by hand, the left side of the frame, and cause the ends 122 of all of the fifth arch members 30 to come into contact with the ground (S1016). The floor, if desired, may be installed before or after the other components of the shelter are assembled together.

The illustrated shelter 10 may be constructed efficiently and quickly. All of the various parts are sized and grouped to be handled individually by a single person. All of the connections for the center top portion of the shelter, including connections made within the frame, and connection of lighting, and other devices, may be done while the frame is in the sub-assembly configuration shown in FIG. 12, before the first and fifth arch members 22, 30 are unfolded to raise the frame (and the shelter 10) to its finished height.

Moreover, all of the individual components may be sized for convenient packing in canvas bags or the like. In a preferred embodiment of the invention, the length of each arch member 22, 24, 26, 28, 30 is about the same as that of the brace arms (also called purlins) 70, 72, 74, 76, 78, 80, 82, 84, 86, 88. There is no piece or individual component of the shelter 10 that is substantially longer than the other pieces of the shelter. This way, the parts can be packed together in a compact volume (e.g., crate 38) for storage and transport. Also, the parts can be grouped together into a small number of canvas bags 51 or the like, each not too heavy for a person to carry, so that the parts can be moved into place for construction easily from the storage container 38. If desired, the bags can be marked for separate identification, for ease of sequential construction. This way, the people who are assembling the shelter can operate efficiently as a team. Tools for assembling the shelter, including wrenches (not illustrated) for connecting the elements of the frame to each other, and a sledge hammer (not illustrated) for driving the stakes into the ground, may be provided in the crate 38 or transported separately.

Figure 18:
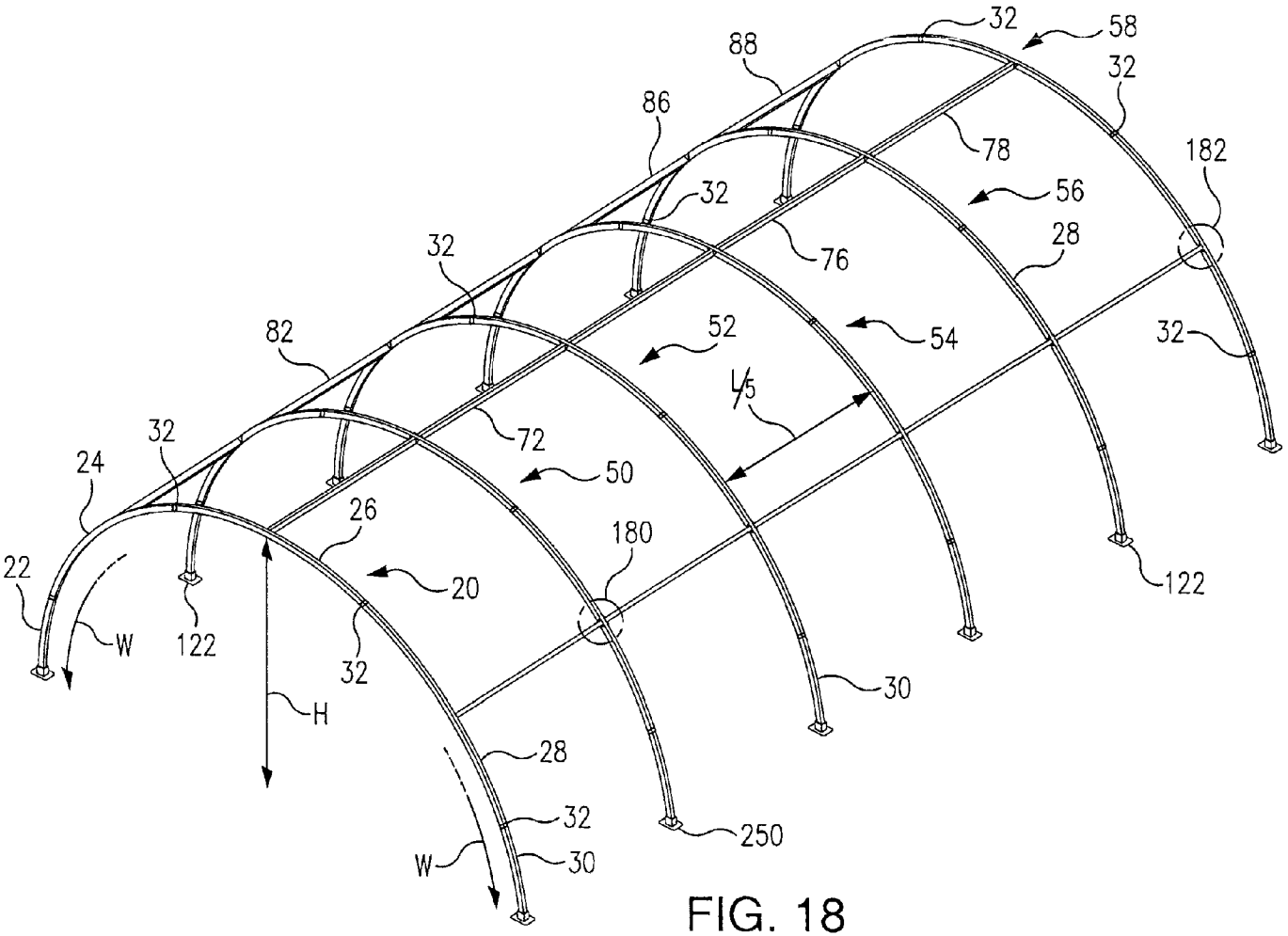
FIG. 18 is a perspective view of the frame for the shelter of FIG. 1.
Figure 19:
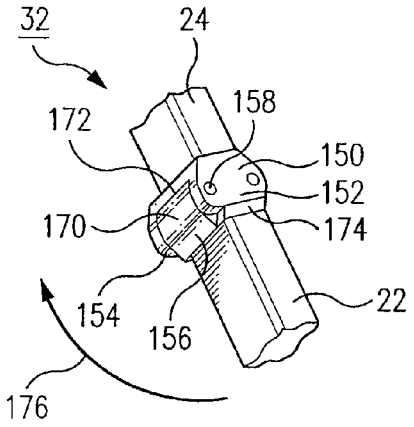
FIG. 19 is a perspective view of one of the arch hinges of the frame of FIG. 18.
Figure 20:
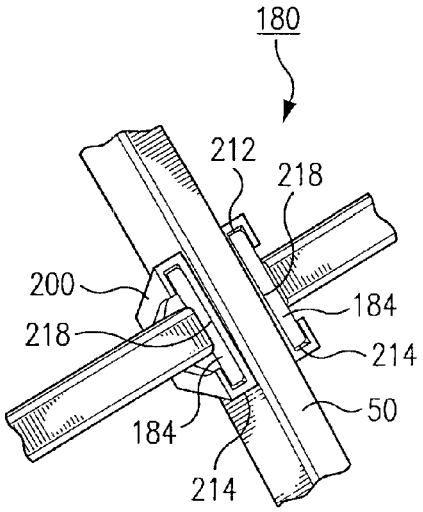
FIG. 20 is a perspective view of a two-purlin connection for one of the interior arch assemblies of the frame of FIG. 18.
Figure 21:
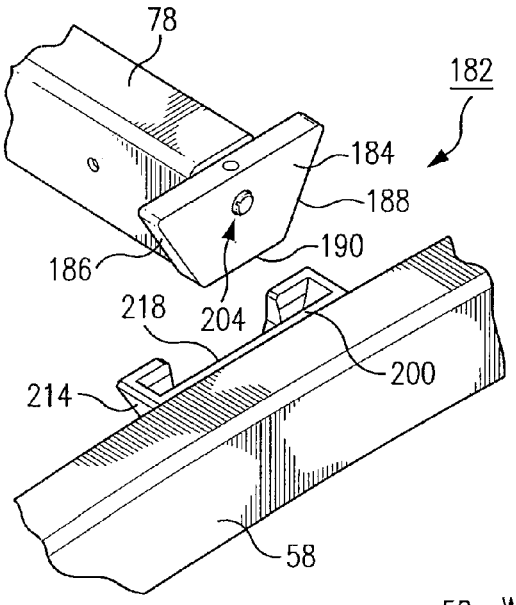
FIG. 21 is a perspective view of a single-purlin connection, in an un-assembled state, for the arch assemblies that are located at the ends of the frame of FIG. 18.
Figure 22:
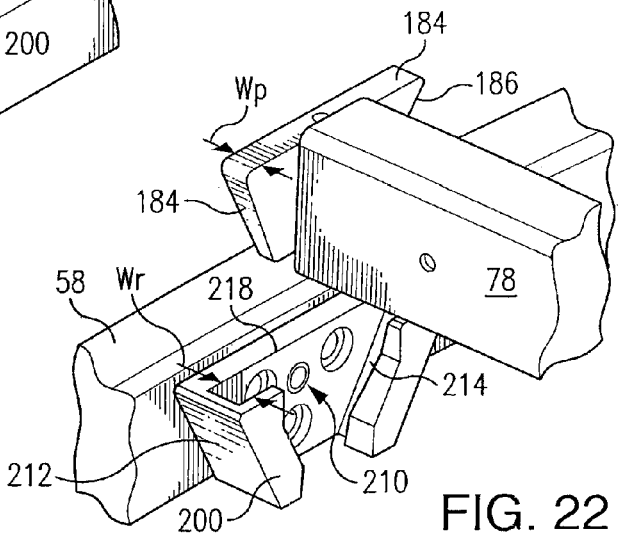
FIG. 22 is a perspective view of the un-assembled connection of FIG. 21, viewed from the opposite direction.
Figure 23:
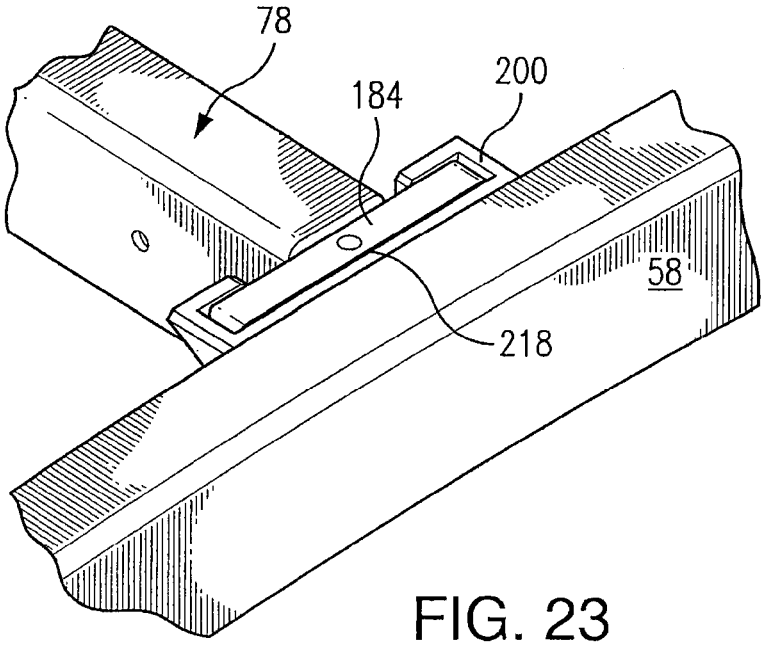
FIG. 23 is a perspective view of the connection of FIG. 21, in a snapped-together state.
Figure 24:
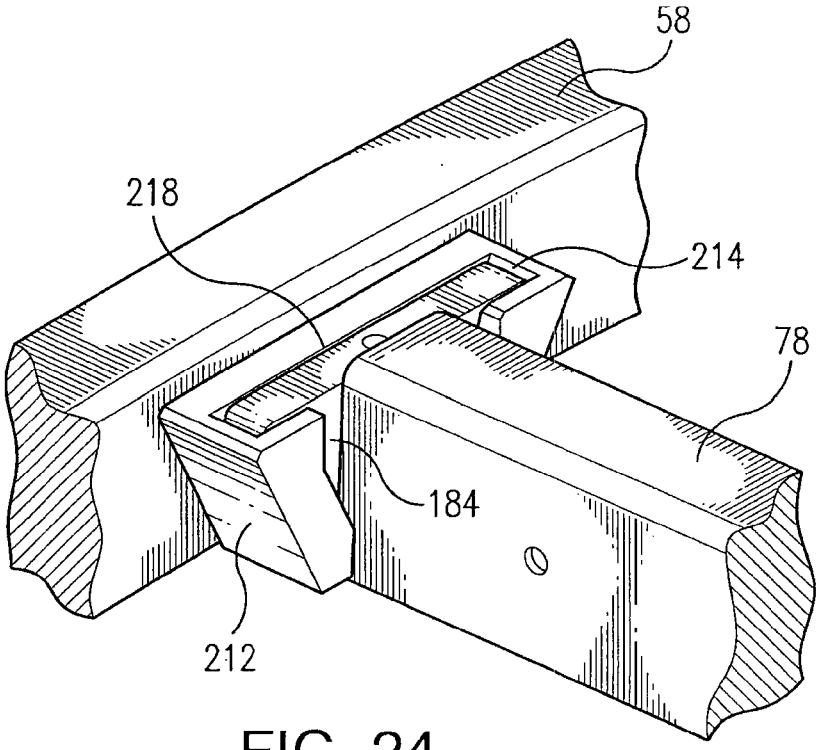
FIG. 24 is a view like FIG. 23, showing the snapped-together connection from the other direction.

FIG. 18 shows the frame as it would look if the liner layer 100 and the cover 110 were removed after all of the arch assemblies 20, 50, 52, 54, 56, 58 were fully extended, and an exemplary hinge 32 is illustrated in FIG. 19. The hinge 32 has a U-shaped clevis member 150 with two ears 152, 154 that enclose a detent member 156. A pin 158 extends through the ears 152, 154 and the detent member 156, to thereby rotatably connect the detent member 156 to the clevis member 150. In operation, the hinge 32 permits free rotation of the detent member 156 relative to the clevis member 150, as the first arch member 22 is moved away from the second arch member 24, starting from the folded position shown in FIG. 4, toward and nearly to the extended position shown in FIGS. 18 and 19.

As the arch member 22 nears the extended position shown in FIGS. 18 and 19, a detent surface 170 of the detent member 156 comes into pressing contact with an inner surface 172 of the clevis member 150. To reach the fully-extended position shown in FIGS. 18 and 19, the detent surface 170 presses past the inner surface 172, causing the hinge 32 to snap into, and to tend to remain in, the extended position. In the extended position, flanges 174 are pressed against the ears 152, 154 to prevent further rotation of the first arch member 22 relative to the second arch member 24 in the extending direction, while the detent surface 170 and the inner surface 172 engage each other to yieldably prevent relative rotation in the opposite (folding) direction 176. Thus, the hinges 32 for the frame can be snapped into their respective extended positions during steps S1010, S1014 and S1016 (FIG. 17), and subsequently snapped back into their folded positions for disassembly, movement and/or storage of the shelter 10.

Further, as shown in FIGS. 20-24, the connections 180, 182 between the brace arms (also called purlins) 70, 72, 74, 76, 78, 80, 82, 84, 86, 88 and the respective arch assemblies 20, 50, 52, 54, 56, 58 may be provided with a snap-in functionality to facilitate the ease and speed with which the shelter 10 may be constructed and disassembled. In particular, each purlin (FIG. 21) has a downwardly-pointing four-sided polygonal plate 184 at each end. The plate 184 may be welded or bolted, for example, to the end of the purlin. The sides 186, 188 of the plate 184 are angled inwardly toward the bottom 190, so as to fit into a matching truncated-V shape of a receptacle 200. Protruding from the exterior surface of the plate 184 may be a ball nose spring-loaded plunger 204, the ball-shaped end of which is biased axially with respect to the purlin outwardly from the plate 184 by a coil spring (not shown).

The receptacle 200 has a matching hole 210 (FIG. 22) that operates as a ball nose spring plunger catch. The hole 210 is positioned to be aligned with the plunger 204 when the plate 184 is fully inserted into the receptacle 200, with the weight of the purlin being supported by the angled sides 212, 214 of the receptacle 200. The width Wr of the receptacle 200 is only slightly greater than the width Wp of the plate 184. Consequently, as the plate 184 is moved downwardly into the receptacle 200, the plunger 204 is pushed into the plate 184, and the spring is compressed, by a camming motion of the nose of the plunger 204 against the inner edge 218 of the receptacle 200. Then, as the plate 184 moves downward to reach a fully-inserted position within the receptacle 200, the nose moves axially outward and snaps into the hole 210.

Figure 26:
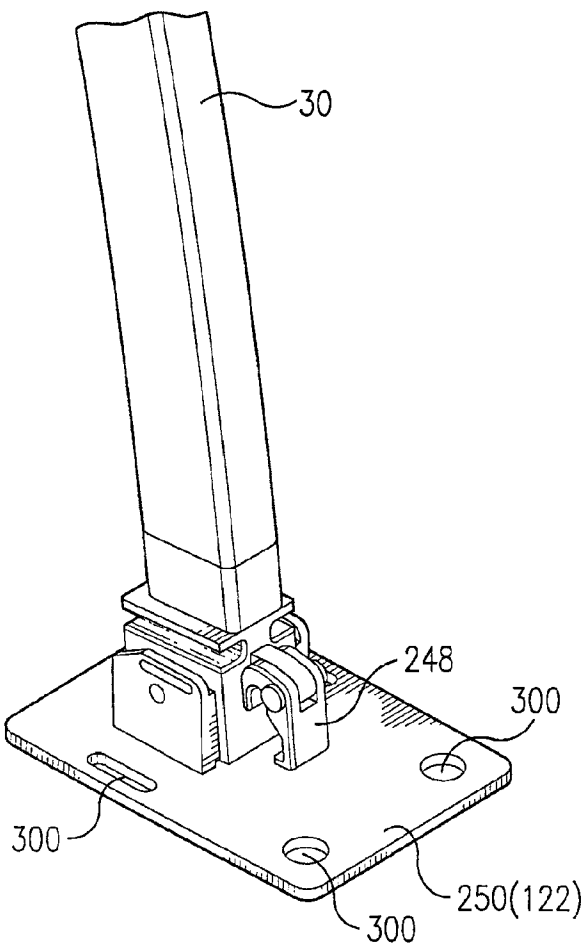
FIG. 26 is perspective view of a hinging base pad for the frame of FIG. 18.

Exemplary details of the cover 110 are shown in FIG. 25. As the assembly of the shelter 10 nears completion, the openings 238 at the corners of the shelter 10 are sealed shut by a suitable contour zipper 240, and a seam 242 formed by hook and loop fasteners. The corner of the cover 110 may be provided with a tension loop 246 that is secured onto a latch 248 (FIG. 26) formed on a base pad 250 that may be located at the bottom ends 122 of each of the arch assemblies 20. The base pads 250 are hinged with respect to the arch assemblies so as to fold compactly therewith during storage and/or transport. As explained above, the four openings 238, 120 (FIG. 16) provide slack within the cover 110 so that the cover 110 can be placed on the frame before the end arch members 22, 30 are rotated into their extended positions, and the openings 238, 120 provide convenient access into and from the shelter 10 during assembly until the door 114 is set up for operational use.

Figure 27:
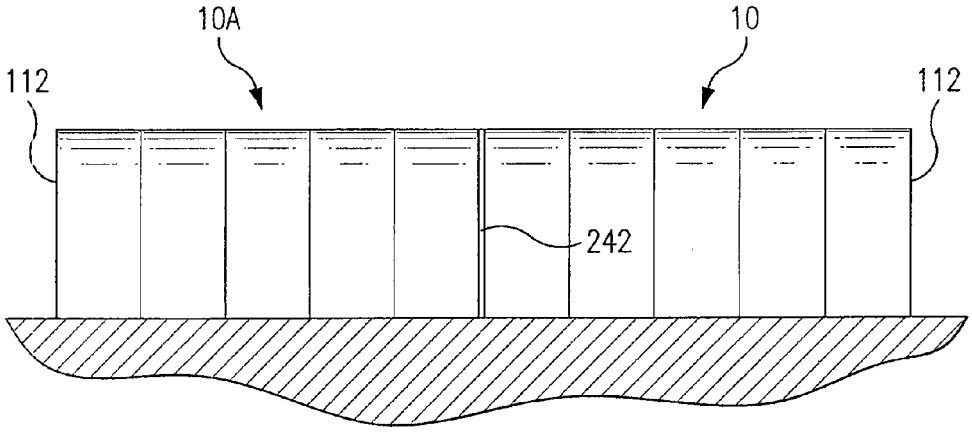
FIG. 27 is a schematic side view of a combined shelter constructed according to a preferred embodiment.

The zippers 240 at opposite ends of the shelter 10 may be complementarily configured such that two or more shelters 10, 10A may be connected end-to-end, as shown in FIG. 27, to create a combined shelter 10, 10A. FIG. 27 shows a combined shelter 10, 10A that is essentially twice the size of the shelter 10 shown in FIG. 1. The two shelters 10, 10A that make up the combined shelter 10, 10A may be essentially identical to each other. In FIG. 27, the first shelter 10 is closed at one end by a flexible end panel 112 and open at the other end. The open end of the first shelter 10 is connected by complementary zippers 240 (FIG. 25) to an open end of the second shelter 10A (FIG. 27), and the second end of the second shelter 10A is closed by a flexible end panel 112. The zippered connection 240 is then sealed against dust, insects and the like, along its entire extent, by a seam formed of complementary hook and loop fasteners 242. In the illustrated embodiment, the seam 240 may be about four inches wide.

Figure 28:
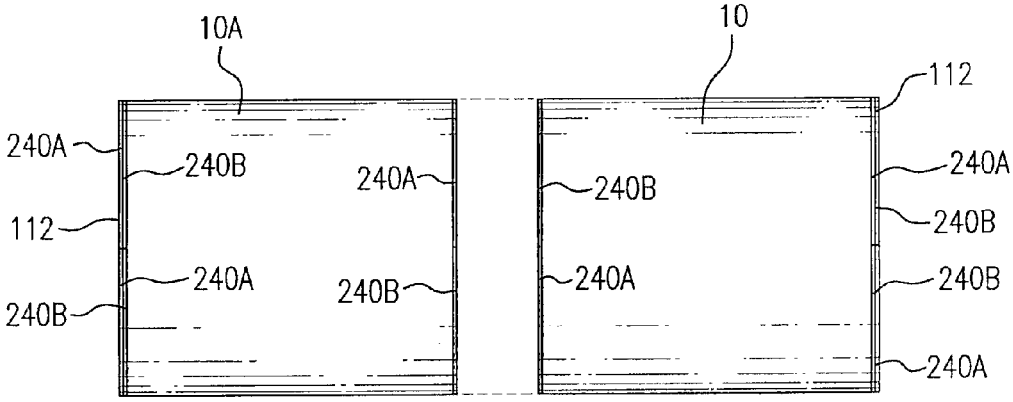
FIG. 28 is a schematic top view of the combined shelter of FIG. 27.

Referring now to FIG. 28, in a preferred embodiment of the invention, each zipper 240 consists of two complementary zipper parts 240A, 204B. Each first zipper part 240A has a box 2402 for receiving a pin 2404 of a second zipper part 240B. In addition, each first zipper part 240A has a slider 2406 (FIG. 25) for meshing the teeth of the mating chain 240A, 240B, as the slider 2406 is moved from the top of the shelter to the ground.

Thus, in the arrangement shown in FIG. 28, first and second zippered seams are formed at the right end of the shelter 10, between the right end of the shelter 10 and an end panel 112. First and second zippered seams are also used to connect the two shelters 10, 10A together. Finally, a third set of first and second zippered seams are used to connect an end panel 112 to the left end of the second shelter 10A. In this way, all of the panels 112 and the shelters 10, 10A may be constructed identically, whether two, three or more shelters 10, 10A are connected together. In each zipper seam, the closing operation starts at the top of the shelter and finishes at the ground.

The invention is not limited to the structures, methods and instrumentalities described above and shown in the drawings. The invention is defined by the claims set forth below.

What is claimed and desired to be protected by Letters Patent of the United States is:

1. A portable shelter for sheltering materials or human occupants at a remote location, said shelter comprising:

a flexible cover; and a frame for supporting the flexible cover, the frame having a length in a first direction and a width in a second direction, the length being greater than the width, and the second direction being perpendicular to the first direction; and wherein the frame includes first and second hinged members for supporting a first side and then a second side of the shelter; and wherein the frame includes arches extending in the second direction, wherein one of the arches includes the first and second hinged members, and wherein each one of the arches has an arched configuration, and wherein each one of the first and second hinged members has an arcuate shape to conform to the arched configuration, and wherein the frame includes braces located between the arches; and snap-in purlin connectors for releasably connecting the braces to the arches; and wherein the frame includes third and fourth members for supporting the portable shelter in a partially-constructed configuration, and-wherein the first and second members are hingedly connected to the third and fourth members, respectively, and wherein the portable shelter has a side wall and an end wall, the side wall extends in the first direction, and the end wall extends in the second direction, and wherein the flexible cover has a closeable corner structure, between the side wall and the end wall of the portable shelter, for providing access into the portable shelter during an intermediate stage of construction; and wherein the first member is movable relative to the third member through a plane that is essentially perpendicular to a line that extends from the hinged connection between the first and third members toward a floor of the portable shelter, and wherein the third member has the arcuate shape.

2. A portable shelter for sheltering materials or human occupants at a remote location, said shelter comprising:

a flexible cover; and a frame for supporting the flexible cover, the frame having a length in a first direction and a width in a second direction, the length being greater than the width, and the second direction being perpendicular to the first direction; and wherein the frame includes first and second hinged members for supporting a first side and then a second side of the shelter; and wherein the frame includes arches extending in the second direction, wherein one of the arches includes the first and second hinged members, and wherein each one of the arches has an arched configuration, and wherein each one of the first and second hinged members has an arcuate shape to conform to the arched configuration, and wherein the frame includes braces located between the arches; and snap-in purlin connectors for releasably connecting the braces to the arches;

wherein said shelter includes: plural arch assemblies each including five arch members hinged and folded together so that the arch assemblies are not substantially longer than any one of the arch members; hinges located between the arch members for yieldably retaining the arch assemblies in partially-extended configurations or fully-extended configurations; and braces for connecting the arch assemblies together in an essentially parallel arrangement, none of the braces being substantially longer than any of the arch members; and wherein the second, the third, and the fourth arch members are configured to be unfolded from the respective arch assemblies to support a partially-constructed configuration of the portable shelter resting on the hinges between the first arch member and the second arch member and the hinges between the fourth arch member and the fifth arch member, and wherein the first and fifth arch members are configured to be unfolded from the respective arch assemblies to support a fully-constructed configuration of the portable shelter resting on an end of the first arch member and an end of the fifth arch member; and wherein the arch assemblies are arranged to be secured in an arcuately aligned configuration to support the flexible cover;

wherein each arch member has a radius R and an arcuate length of about W/5, where R is at least nine feet and approximately equal to the headroom of the portable shelter when fully constructed, and where W is the arcuate length of the respective arch assembly when the portable shelter is fully constructed.

3. The shelter of claim 2, further comprising a floor connected to the arch assemblies for tensioning the flexible cover.

4. The shelter of claim 3, wherein the flexible cover includes a door for allowing a person to walk into and out of the structure.

5. The shelter of claim 4, further comprising a container for transporting the arch assemblies, the braces, and the flexible cover to a remote location.

6. The shelter of claim 2, wherein the hinges are snap-locking hinges.

7. The shelter of claim 2, wherein the flexible cover has a closeable corner structure, between a side wall and an end wall of the portable shelter, for providing access into the portable shelter during an intermediate stage of construction.

8. The shelter of claim 7, wherein the closeable corner structure includes a zipper and/or hook and loop fasteners.

* * * * *